US008206786B1

(12) United States Patent
Weiner

(10) Patent No.: US 8,206,786 B1
(45) **Date of Patent: *Jun. 26, 2012**

(54) CARPET TILE CURVED CHANNELING PROCESS

(75) Inventor: Robert S. Weiner, Atlanta, GA (US)

(73) Assignee: Milliken & Company, Spartanburg, SC (US)

( * ) Notice: Subject to any disclaimer, the term of this patent is extended or adjusted under 35 U.S.C. 154(b) by 353 days.

This patent is subject to a terminal disclaimer.

(21) Appl. No.: 12/546,054

(22) Filed: Aug. 24, 2009

Related U.S. Application Data

(63) Continuation-in-part of application No. 12/351,172, filed on Jan. 9, 2009, now abandoned, which is a continuation-in-part of application No. 11/709,366, filed on Feb. 22, 2007, now Pat. No. 7,842,346, and a continuation-in-part of application No. 11/789,956, filed on Apr. 26, 2007, now Pat. No. 7,673,378, and a continuation-in-part of application No. 12/118,962, filed on May 12, 2008, now Pat. No. 7,765,654.

(51) Int. Cl.
*B05D 3/12* (2006.01)

(52) U.S. Cl. ..... 427/264; 427/261; 427/271

(58) Field of Classification Search ..... 427/261, 427/264, 271

See application file for complete search history.

(56) References Cited

U.S. PATENT DOCUMENTS

| | | | | |
|---|---|---|---|---|
| 4,010,302 | A * | 3/1977 | Anderson et al. | 428/95 |
| 4,629,858 | A * | 12/1986 | Kyle | 219/121.69 |
| 6,059,391 | A * | 5/2000 | Fulkerson et al. | 347/2 |
| 7,374,808 | B2 * | 5/2008 | Sellman et al. | 428/94 |
| 7,673,378 | B1 * | 3/2010 | Weiner | 29/417 |
| 7,765,654 | B2 * | 8/2010 | Weiner | 26/16 |
| 7,842,346 | B1 * | 11/2010 | Weiner | 427/264 |

* cited by examiner

*Primary Examiner* — Frederick Parker
(74) *Attorney, Agent, or Firm* — Brenda D. Wentz

(57) ABSTRACT

A method of producing a decorative carpet tile may include providing a carpet tile in accordance with the prior art techniques and then treating at least two carpet tiles in one of various manners to provide separations internal to side edges of the carpet tile. Specifically, two tiles can be treated simultaneously, in register and/or without moving the second tile after treating the first tile.

10 Claims, 6 Drawing Sheets

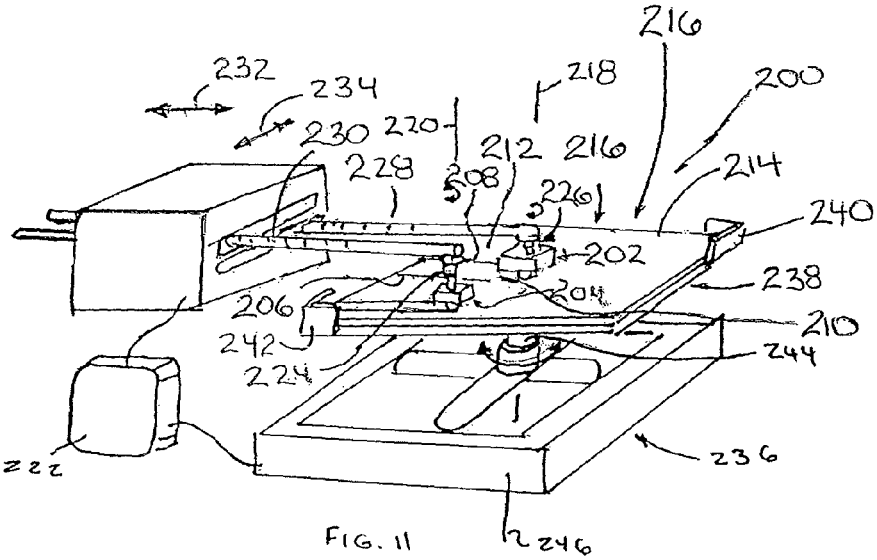
FIG. 11
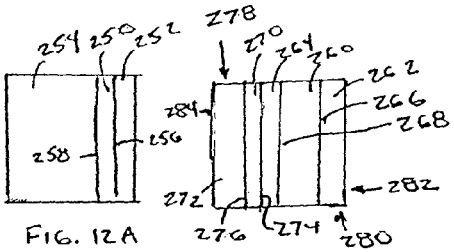
FIG. 12A
FIG 12B
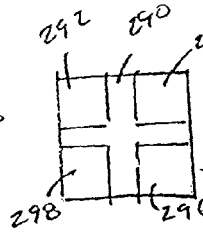
FIG 12C
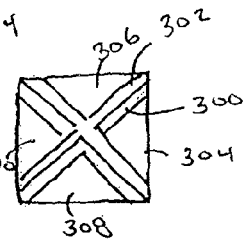
FIG 12D
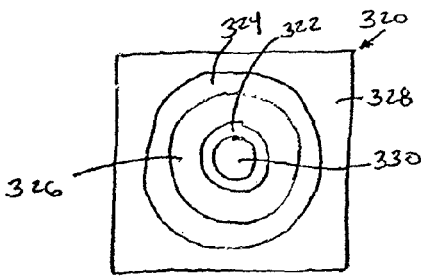
FIG 12E
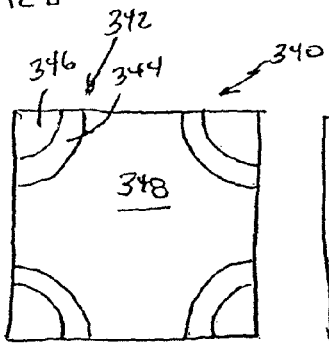
FIG 12F
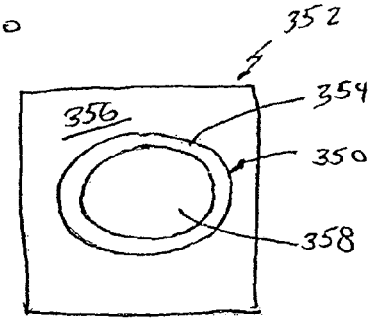
FIG. 12G

CARPET TILE CURVED CHANNELING PROCESS

CLAIM OF PRIORITY

This application is a continuation-in-part of U.S. patent application Ser. No. 12/351,172 filed Jan. 9, 2009, now abandoned, which is a continuation-in-part of U.S. patent application Ser. No. 11/709,366, now U.S. Pat. No. 7,842,346 filed Feb. 22, 2007, U.S. patent application Ser. No. 11/789,956, now U.S. Pat. No. 7,673,378 filed Apr. 26, 2007, and Ser. No. 12/118,962, now U.S. Pat. No. 7,765,654 filed May 12, 2008, all of which are incorporated herein by reference.

FIELD OF THE INVENTION

The present invention relates to a carpet tile and a method of its production wherein a carpet tile is configured to have a channel of at least one row or track relative to at least one second portion and more particularly to carpet tiles and method of production wherein a separation appearance is provided by at least one of carving a curved channel to provide the appearance of a separation clearly defined internal to the boundary edges of the carpet tile after production of the tile from carpet rolls.

DESCRIPTION OF RELATED ART

Carpet tile has been made for many years by many different companies. In making carpet tile, carpet tile is typically made as carpet and then cut with a press to a specific dimension to provide carpet tiles. The edges are then normally trimmed substantially perpendicularly to an upper face of the carpet tile and the tile is then ready for distribution and installation. While many designs have been created over the years by various manufacturers, the applicant is unaware of carpet tile treatment methods performed after cutting the tiles apart with the one exception of treating side edges to attempt to ensure that no strands remain after a die cutting process which may otherwise leave a somewhat unattractive appearance at the side edges. More specifically, the applicant is unaware of any manufacturer that treats any upper surfaces of cut tile to provide aesthetically pleasing designs with a separation such as a track, stripe, or other design distinguishing at least some internal portions after the tufting process and after being cut into tiles.

Furthermore, although tip shearing carpet from carpet rolls is known in the art to tip shear across carpet at a predetermined height relative to the backing, this process causes the highest carpet to be sheared. The tips of these sheared portions are still at a highest point of the carpet and can be exposed to wear. When wear occurs, there is a tenancy for the ends to bend over, thus distorting the look over time.

Applicant's U.S. Pat. No. 7,146,693 relates to a method of utilizing an embossed roller which can cause patterns to be cut into carpet below what would otherwise be an upper surface of carpet. While that method is effective at producing patterns in carpet, the pattern on the roll or belt is what is produced in the carpet. Changing that pattern would require replacement with either another roll or belt. Furthermore, the tip shearing necessarily occurs in a single direction relative to a direction the carpet passes through the tip shearing/roller assembly. Changing direction of cut relative to the direction of travel for the carpet roll is not possible.

Also, in many prior art embodiments, clear separation from treated and untreated areas may be difficult as it is difficult to envision a situation where the backing could instantaneously change a predetermined height based on an embossed pattern on a roller, but instead would appear to take at least a limited distance to make this transition as the backing cannot make an instantaneous elevation transition. Of course, a transition may be desirable in some situations.

While using carpet carving equipment on rugs has been performed in the prior art to carve designs into rugs, these rugs are carved prior to binding and do not have a modular tile backing as is applied to tiles. In fact, carved rugs are not known by the applicant to ever be converted into carpet tiles as it is a separate market. Furthermore, a single rug is believed to be carved at a time with existing equipment, with no effort made to cut a plurality of tiles simultaneously.

Accordingly, a new method of carving carpet tile is perceived to be advantageous over the prior art in order to provide new carpet tile designs and configurations to the marketplace.

SUMMARY OF THE INVENTION

It is an object of the present invention to provide an improved carpet tile construction and method of its manufacture.

It is another object of at least some embodiments of the present invention to provide a method of carving a design including curves into a plurality of carpet tiles in at least one presently preferred embodiment of the present invention.

It is another object of at least some embodiments of the present invention to provide at least one curved separation internal to edges of the carpet tile after preparing the carpet tile from a carpet roll which is cut after applying a modular tile backing.

In accordance with a presently preferred embodiment of the present invention a carpet after having had a modular tile backing applied, been cut into a tile, and then is carved, channeled or otherwise treated with a curved design to provide an internal separation such as a stripe, track and/or design differentiating selected lower cut pile (side first portions) from the uncut or unselected pile (in internal second portions) separated by a discontinuity of the separation. The channeling process stops at the discontinuity which can, in some embodiments, provide a visible line parallel, or not, to the edge depending upon the orientation of the carpet relative to a cutting head during the cutting process. Intersecting effects may be provided using more than one cutting head and/or more than one pass. Programmable controllers and/or other positioners may be utilized to assist in positioning the cutting head and/or tile so that one or more designs can be cut or otherwise provided internal to edges of carpet tiles once cut from rolls of carpet. Additionally, a plurality of tiles may be cut in register, simultaneously with similar and/or cooperating designs with a common treatment device continuing over the edge of one tile and onto another tile. In still other embodiments, the tile can be turned while being cut to provide a curved stripe on the tile.

Other methods of creating the illusion of a curved line of various selected widths or even varying widths can include tip shearing, burning, or otherwise defining an internal line by treating side portions. Furthermore, dripping and/or overdying, a design and/or creating a line could also be provided. When utilized with other similarly prepared tiles, a series of designs can provide additional effects, or even cooperating effects, which heretofore is not believed to have been done in the prior art, particularly when treating multiple tiles simultaneously.

BRIEF DESCRIPTION OF THE DRAWINGS

The particular features and advantages of the invention as well as other objects will become apparent from the following description taken in connection with the accompanying drawings in which:

FIG. 11 is a top perspective view of another alternatively preferred equipment showing the process of producing framed carpet tiles in accordance with a presently preferred embodiment of the present invention;

FIGS. 12A-12G are top plan views of various embodiments formed using the equipment shown in FIG. 11 or FIGS. 13-14;

DETAILED DESCRIPTION OF THE PREFERRED EMBODIMENT

Figure 1:
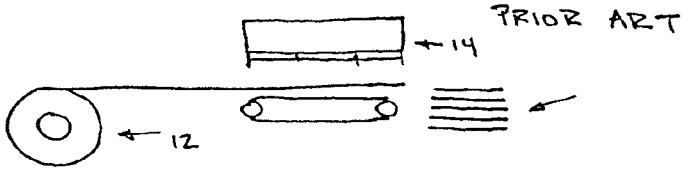
FIG. 1 is a diagrammic representation of a prior art method of cutting carpet tiles from a roll of carpet.

FIG. 1 shows a prior art diagrammic representation of a method of making carpet tiles 10 as would be known by one of ordinary skill in the art. Carpet from a roll 12 is directed to a die 14 where individual carpet tiles are produced by cutting after applying a modular tile backing to the carpet. In the prior art, trimming edges with an edger to attempt to remove loose yarn was performed, but there was not believed to be a further effort to tip shear or otherwise treat upper surface portions of carpet tiles 10 once cut with the die 14.

The applicant initially developed a manufacturing process 20 from which carpet tiles 10 such as carpet tiles 10 can be placed at entry 22 and directed towards a first station 24 which is illustrated treating upper surfaces one of the four sides 26 of carpet tile 28 and it proceeds through the process 20. Claims directed to that method are provided in a co-pending application. Specifically, instead of being located to treat an edge of the carpet tile edger 30, an edger 32 or other treatment apparatus has been turned 90 degrees relative to edger 30. In this manner edger 32 effectively tip shears an outer or side portion 34 seen in FIG. 3A. Edger 30 then edges the side as has been known in the prior art which potentially removes strands of yarn but does not tip shear or otherwise treat an upper surface of the carpet internal to edge 36 as is contemplated by the presently preferred embodiment. In some embodiments this is a finished product.

Figure 2:
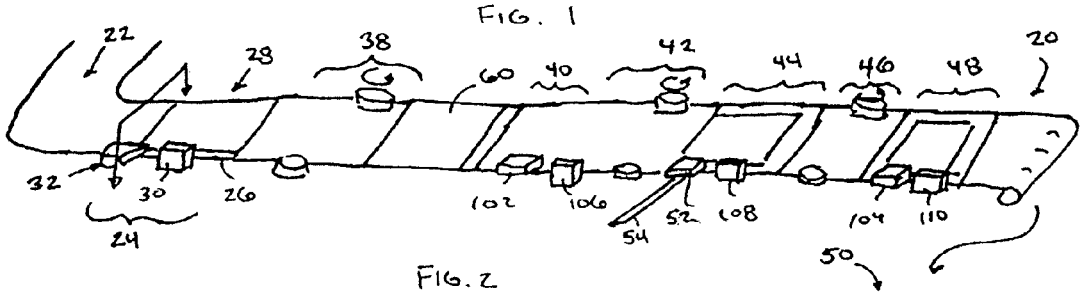
FIG. 2 is a top perspective view of a process of producing framed carpet tiles in accordance with an alternatively preferred embodiment of the present invention.

In other embodiments, the carpet proceeds from the first station 24 to the first turning station 38 which turns the carpet tile 28 ninety degrees to the position shown in the first station 24 as it is fed into the second treatment station 40 where a second side portion is treated. Once again, this could be a finished product or could then proceed to a second turning station 42 then to a third treatment station 44 and then possibly to a third turning station 46 and to a fourth treatment station 48 before being deposited as a framed carpet tile 50 as illustrated in FIG. 2. The third treatment station 44 shows an alternatively preferred feature relative to the other three cutting stations 24,40,48 in that the cutter 52 is located on a slide 54 so that it can slide in and out to create various effects in the frame such as scalloped edges 56 shown in FIG. 6 or even points 58 or other features as would be desired. It also provides for adjustable thicknesses of side portions 34 and/or desired placements of frame 70 relative to carpet tile perimeter 102. Although only the third treatment station 44 is shown having this capability, those of ordinary skill would know all the treatment stations 24,40,44,48 could have this capability in other embodiments.

Figure 17:
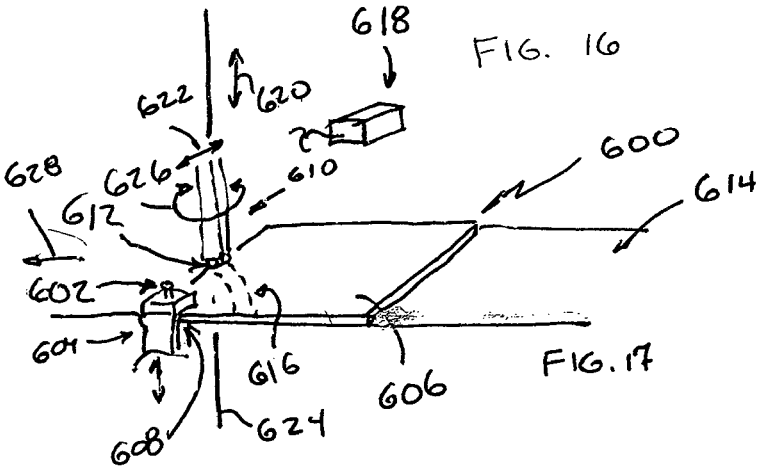
FIG. 17 is a top perspective view of an alternatively preferred embodiment system similar to FIG. 2.

FIG. 17 shows an alternative embodiment of a turning station 600 such as first turning station 38, second turning station 42, etc. Turning station 600 is discussed in further detail below.

Figure 9:
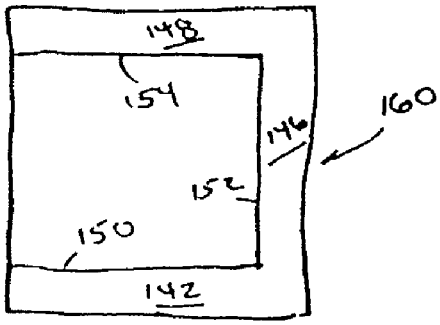
FIG. 9 is a top plan view of a fifth alternatively preferred embodiment with three of four sides treated.
Figure 10:
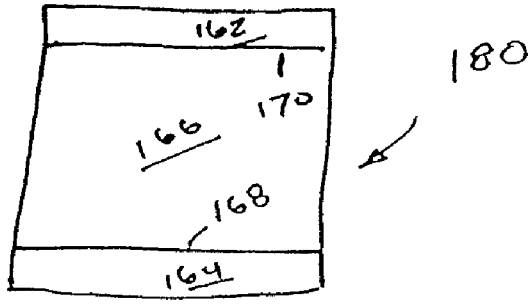
FIG. 10 is a top plan view of a sixth alternatively preferred embodiment with treated opposite sides.
Figure 13:
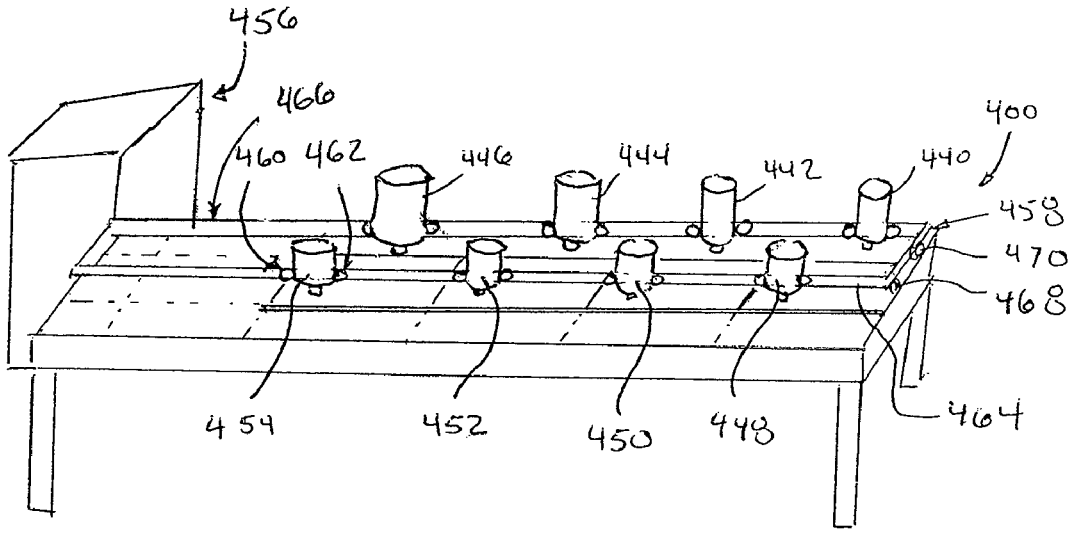
FIG. 13 is a front perspective view of a carving table shown with a plurality of tiles being simultaneously carved in accordance with a presently preferred embodiment of the present invention.

As a first generation improvement, although four separate cutting stations 24,40,44,48 are illustrated as would be understood by one of ordinary skill in the art, it may be possible to have two stations operate at the same time such as cutting parallel side portions at the same time (i.e., opposing sides) such as to provide the embodiment illustrated in FIG. 10. Furthermore, in other manufacturing practices, it may be possible to have one or more treatment stations perform all of the desired treatments in one or more steps. The applicant has found that the process 20 illustrated has been found to be a particularly attractive way of producing an attractive framed carpet tile 50 and that portions of the process so attractive for the embodiments of FIGS. 7-10.

Figure 3A:
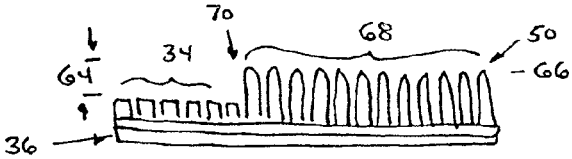
FIG. 3A is a cross-sectional view taken along line A-A of FIG. 2.

As one can see from FIG. 3A, which reflects the cross section A-A in FIG. 2 of a carpet tile 28 as it is proceeding through the process 20, the cutter 32 cuts side portion 34 to a depth 64 lower than an elevation 66 of uncut portion 68 thereby providing a noticeable separation 70 forming a portion of a frame intermediate the side portion 64 and the interior portion 68 (it will be understood that other portions of the interior portion 68 will be treated through the process 20). This separation 70 can be better seen as interior parallel lines in FIG. 4B which can define a rectangle to provide a framed tile 50 as shown in FIGS. 2, 3A and 4B which in some embodiments is shown in a square internal to and centrally disposed relative to external square design of the perimeter 72 of the carpet tile 50 shown in FIG. 4B. The perimeter of carpet tile 50 has first, second, third and fourth edges 51,53,55,57.

Figure 3B:
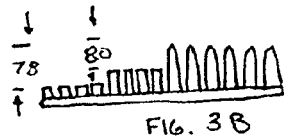
FIG. 3B is a cross-sectional view taken along line A-A of a first alternative embodiment of FIG. 2.
Figure 4A:
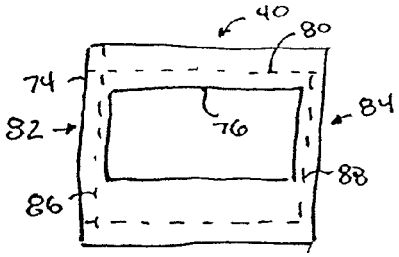
FIG. 4A is a top plan view of the embodiment of FIG. 3B.
Figure 4B:
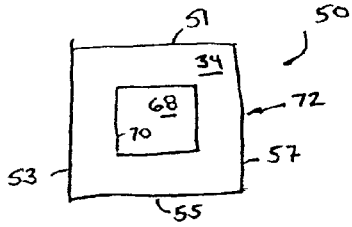
FIG. 4B is a top plan view of the embodiment of FIG. 3A.

The alternate embodiment shown in FIG. 4A has a perimeter 74 which is identical to that of perimeter 72 but can be of any other shape as carpet tiles are known to be produced. The internal frame perimeter 76 is rectangular but not square due to a difference in the thickness of side portions 34 as cut during the process 20. Additionally, as shown in FIGS. 4A and 3B, more than one elevation differential illustrated as first depth 78 and second depth 80 can provide a second frame perimeter 80 or even just separate line 80 which may not be a compete perimeter but may instead proceed from first edge 82 to second edge 84 such as if segments 86 and 88 are not cut to first depth 78 as would be understood by one of ordinary skill in the art. This could add even further additional effects which gave rise to the embodiments of FIGS. 7-10.

Figure 6:
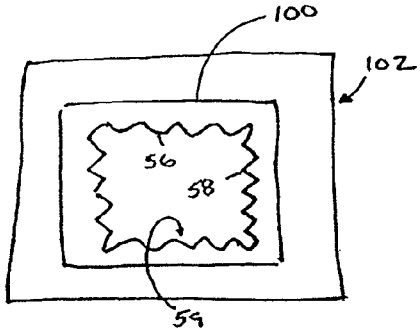
FIG. 6 is a top plan view of a second alternatively preferred carpet tile embodiment.

It may be important for one of ordinary skill in the art to remember that a design has likely been tufted into the carpet tiles 50,90 during the tufting process and/or over dyed either before the process 20 or after so that the effect of creating at least a portion of the internal frame designed by perimeter 70 and 76 as well as 56 and 58 in the embodiment of FIG. 6 is believed to add dramatic effects than previously performed methods.

Figure 5:
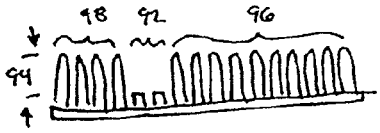
FIG. 5 is a cross-sectional view taken along line A-A of an alternatively preferred embodiment.

FIG. 5 shows a cross-sectional view of another embodiment which could be similar to that illustrated in 4B where a portion 92 is cut, carved, burned or otherwise provided a depth 94 into the carpet to distinguish section 92 from adjacent sections 96 and 98. In addition to cutting and carving, other frames or designs may be provided in other embodiments in conjunction with removal of carpet as has been described above or with coloring by dripping or otherwise providing a coloration of a post treatment after cutting the tiles 10 in a new manner that has not believed to have been previously performed in the prior art. Discontinuity can result from post tufting coloring, carving, burning, cutting, etc., to create a visible discernment from interior portion 68 and at least a portion of side portion 34.

FIG. 6 shows an internal perimeter 59 similar to perimeters 70,76 in that which would be defined by segments such as 56 and 58. This perimeter 59 is not parallel to edges like 51,53, 55,37. Perimeter 59 could be provided as could be shown in FIG. 2 at third station 44 or otherwise to provide a non-linear treatment to side portions to provide this or other frame types. Furthermore, although the internal perimeter defined by 56 and 58 is not linear, it is possible that a second perimeter 100 could be created which is (or is not) linear in conjunction with the non-linear internal perimeters defined by segments 56,58 or others.

Frames or other designs such as looking at FIG. 4B could include the entire side portion 34 as well as a discontinuity 70. In other embodiments it may just include the discontinuity 70 and/or other portions such as the cut portion 92 carved in FIG. 5 which may be cut, burned, or otherwise provided. In yet other embodiments, still other frames may further distinguish internal portion 68 relative to side portions 34 or portion side portions 34 as would be understood in the art. Frames as here defined do not include tufted differences such as if a square pattern were tufted internal to a side portion such as with high and low loops as technology exists to be able to provide that as a design. Furthermore, frames may be provided prior to cutting into tile such as by carving or tip shearing the side portions 34 relative to non-tip sheared internal portions 68 and then cutting into carpet tile in other embodiments.

In the presently preferred embodiment, cutters such as shown at 32,102,52 and 104 are utilized to provide the side portion 34 relative to interior portions 68. The applicant has used a cutting head which is about 2 to 4 inches across which terminates at a sharp cut at junction 70 relative to uncut portion 68 as shown in FIG. 3A. Depending on its placement side portions 34 have been set from ¼ to 4 inches but other dimensions are also possible. Other embodiments may utilize other structures for treatment stations including carvers, burners, applicators, etc., as would be known by those of ordinary skill in the art. The cutters 32,102,52 and 104 are edgers such as edger 30,106,108 and 110 turned 90 degrees to the normal positioning used to trim loose unkempt yarns from edges 51,53,55,57 and not the upper surface of the carpet tile 50.

By providing this method of treating carpet tiles, new and exciting textures and designs are believed to be available to the market which have not previously been provided.

While the framed carpet tiles 40,50 and 102 provide unique products for the marketplace, the applicant discovered while making the framed tiles 40,50,102, that all four sides need not necessarily be treated to provide unique effects presently unavailable in the market. Specifically, FIGS. 7-10 show additional embodiments that can be taken at various stages of the manufacturing process as shown in FIG. 2.

Figure 7:
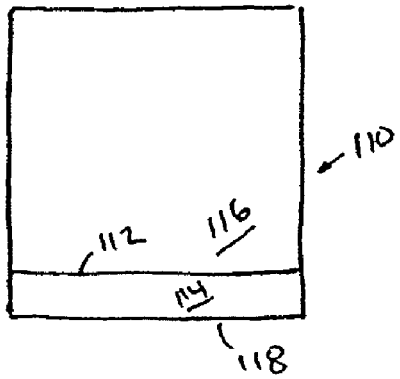
FIG. 7 is a top plan view of a third alternatively preferred embodiment with a single side treatment.

FIG. 7 shows tile 110 having separation 112 distinguishing first portion 114 from second portion 116. Just like has been described above, the preferred method is to tip shear anywhere from about a quarter inch to up to several inches, such as four, from edge 118 to provide first portion 114 as a band defined by separation 112 relative to second portion 116. It is important to remember that in many embodiments, a design of some type will have been tufted and/or dyed into the carpet tile 110 whereby the band provides an additional aesthetic element. When tile 110 is combined with similar or dissimilar tiles 110, such as tiles 120, 140, and/or 160, striking effects can be created whether or not the other tiles 110, 120, 130 or 140 are provided with similar or dissimilar designs and/or coloration schemes.

Separation 112 may be gradual in other embodiments, but in the illustrated embodiment of FIG. 7 is where the edger 32 tip sheared first portion 114 relative to non-treated portion 116. Separation 112 need not be parallel to edge 118 in all embodiments, and need not necessarily be linear in all embodiments, either.

Figure 8:
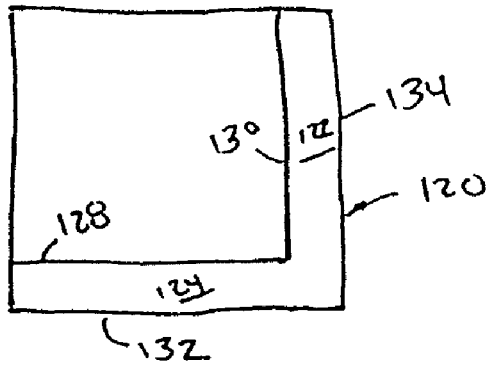
FIG. 8 is a top plan view of a fourth alternatively preferred embodiment with treated adjacent sides.

Using the same basic methodology of making the tile 110 of FIG. 7, tile 120 of FIG. 8 can be made with treatment of third portion 122 relative to at least one of first and second portions 124, 126, respectively. In the illustrated embodiment first and third portions 122, 124 are treated to a similar height so there is no distinguishable separation there between, but this need not be the case for all embodiments. Separations 128 and 130 separate first and third portions 122, 124 from second portion 126. In the illustrated embodiment an "L" shape or "chevron" shape is provided which provides somewhat unique effects when combined with any of the other effects and/or tiles 40,50, 102 of embodiments of FIGS. 7-10 and/or 4A, 4B and/or 6.

Separations 128 and 130 are shown parallel to edges 132 and 134 in the illustrated embodiment. Other embodiments may include these and/or additional effects.

FIG. 9 shows a "U" or "C" style tile 140 with first, third and fourth portions 142, 146, 148 separated from second portion 144 by separations 150, 152, 154. Additional separations could separate any of the first, third or fourth portion 142, 146, 148 from each other such as by varying the amount of tip shearing, or other treatment process.

FIG. 10 shows two treated portions 162, 164 spaced by untreated portion 166 as can be visually distinguished by separations 168, 170.

As one skilled in the art will quickly recognize, the installer will have a host of new options when selecting from the embodiments of FIGS. 4A, 4B, 6, and 7-10 especially if features from those respective embodiments are combined together. The embodiments of FIGS. 7-10 can be made using the process 20 of FIG. 2 by simply de-activating selected cutters 32, 102, 52 and/or 104 may not be utilized at a particular station. Of course the number of stations 24, 40, 44, 48 can be reduced as well as would be understood by those of ordinary skill in the art.

FIG. 11 shows another generation of advance by the application showing an alternative embodiment of a carpet tile treatment station 200 which can be utilized to treat individual tiles in the presently preferred embodiment. Carpet tile treatment station 200 has one or more treatment devices 202,204 which impart one or more separations 206,208 to distinguish first portion 210 relative to second portion 212 in the embodiment of a cutter. The cutter can tip shear first portion 210 relative to the second portion 212 and thereby establish separations 206,208 distinguishing the two portions at the upper surface 214 of carpet tile 216 where the treatment agents 202,204 are configured to treat the carpet tile 216 to provide a plurality of design options. In the illustrated embodiments treatment agents 204,206 may be positionable about respective axes 218 and 220 either by being manually set in a desired position and/or being programmably controllable and/or otherwise positionable such as with controller 222 which could be computer PLC or other controller 222 coupled to a Servo and/or other device and possibly may also adjust the relative elevation of treatment agents 202,204 such as by having piston members 224,226 extend or retract treatment devices 202,204 relative to the upper surface 214 of the carpet tile 216. Heights may be preset, adjustable and/or programmably adjustable.

Furthermore, it may be possible to move the treatment devices 202,204 or not relative to the carpet upper surface 214 the carpet tile 216 such as with extension arms 228,230 or otherwise. Extension arms 228,230 may be movable along axis 232 and/or parallel to axis 232 and/or movable parallel to or on the axis 234 as would be obvious to one of ordinary skill in the art. The illustrated embodiment shows just one mechanism of three dimensional movement of treatment devices 202,204. Two dimensional movement and/or three dimensional movement through other mechanisms may also be desirable and/or provided in other embodiments and which could be accomplished by means as known to those of ordinary skill in the art.

In addition to and/or instead of moving the treatment devices 202,204, carpet tiles can be moved such as are shown in FIG. 2 relative to the treatment device such as with a turntable or moving station 236. Moving station 236 preferably provides a support 238 to which a carpet tile 216 can be placed. Retainers 240,242 may be utilized to maintain the carpet tile 216 in contact with support 238 and can take various forms such as clamps, framed ends or other mechanisms as known to those of ordinary skill in the art.

It may also be possible that texture of an upper surface of support 238 may sufficiently cooperate with a lower surface of carpet tile 216 to hold the carpet tile 216 in a desired location during treatment. Treatment station 236 may have a post member 244 at least partially rotatable around an axis 246. Axis 246 may be movable or fixed depending on the various embodiments utilized. In the illustrated embodiment post 244 is movable parallel to axis 232 and 234 such that possibly in combination with controller 222 so that the desired movement of the carpet tile 216 relative to the treatment devices 202,204 could be affected as so desired. Conveyors and/or other moving station components could be employed with other embodiments. Controller 222 may be provided with a plurality of design options such as from a storage device to assist in providing a particular design on carpet tile 216.

In the illustrated embodiment of FIG. 11, either or both of the treatment devices 202,204 and the carpet tile 216 can be moved in relative relationship relative to one another. Post 244 also is illustrated having a piston style construction whereby elevational adjustment of the upper surface 214 of the carpet tile 216 relative to the treatment devices 202,204 can be provided. Other elevation adjustment mechanisms could be employed in other embodiments.

Exemplary embodiments and designs are shown in FIGS. 12A-12G, but still others can be created. Specifically, FIG. 12A shows a first portion 250 distinguished from second portions 252,254 by a first separation 256 and second separation 258.

FIG. 12B shows a construction with first portion 260 separated from second portions 262,264 by first separation 266 and second separation 268 as well as a third separation 270 separated from second portion 264 and another second portion 272 by third separation 274 and fourth separation 276. Notice that the third portion 270 and first portion 260 are different widths in these illustrative embodiments. The applicant envisions widths could vary in range of about half an inch to about three inches depending on the particular treatment device 202,204 selected for that particular application. Still other widths could be selected. About three inches or less has been found to be particularly attractive for some embodiments in that once subjected to wear by foot traffic, a portion of the foot traffic is still directed to second portions such as 262,264,272 which can absorb a significant portion of the load to thereby prevent untimely wear of the tip sheared portions. If a cutter is utilized, first portion 260 and third portion 270 could be protected from excessive traffic thereby potentially prolonging the life of the carpet tile illustrated in FIG. 12B.

In both FIGS. 12A and 12B, the first portion 260 and third portion 270 run from first side edge 278 to third side edge 280 which are parallel to side edges 282 and 284. In other embodiments, this may not necessarily be the case. FIG. 12C shows another alternative embodiment which a "plus" style design is illustrated with first separations 290 separated from second portions 292,294,296 and 298.

FIG. 12D shows yet another embodiment in which first portions 300 and 302 are shown separated from second portions 304,306,308,310 by illustrated separations. Note that first portion 302 is cut deeper relative to upper surface 214 shown in FIG. 11 and first portion 300 thereby giving yet another effect. This design also is provided on a diagonal and may be cut on the diagonal for at least some embodiments.

FIG. 12E shows designs provided on carpet tile need not necessarily extend from side edge to side edge but can be internal to the carpet tile 320. In this design first portion 322 represents a circle cut internal to the carpet tile 320. Third portion 324 and first portion 322 are separated from second portions 326,328 and 330. Of course, in other embodiments a single circle could be provided, other circles provided and/or even more circles could be provided to distinguish from second portions. The treatment devices 202,204 and/or carpet tiles 320 can be moved relative to one another to assist in providing the design.

FIG. 12F shows another embodiment in which it would be understood by those of ordinary skill in the art that carpet tile 340 could cooperate with similar tiles 340 to provide a continuous design. Quarter circles 342 of first portions 344 are distinguished from second portion 346 and 348. To form a circle configuration the first portion 344 would combine with three other carpet tiles 340 meeting at a common corner. Of course, all the other designs and configurations could also be provided as would be understood by those of ordinary skill in the art.

FIG. 12G shows an oval 350 internal to carpet tile 352 having first portion 354 separated from second portion 356 and 358. Utilizing this technology, a whole host of different designs could be provided having varying effects. It is important to remember that these embodiments as utilized with the treatment station 200 shown in FIG. 11 that all carpet tile treatment preferably occurs after the carpet tile is created from rolls of carpet.

While the embodiment of FIG. 11 provides excellent designs, the applicant has realized that it may be advantageous to provide channeled or carved designs in carpet tile simultaneously. Specifically, the applicant is unaware of any attempt with rug carving equipment to carve at least one, if not multiple designs, in multiple tiles simultaneously.

A table 400 supports a plurality of tiles 402,404,406,408, 410,412,414,416. More or fewer tiles 402,404,406,408,410, 412,414,416 could be treated at a time, and/or on a table 400. Indexing indications 418,420,422,424,426,428 may be useful to align tiles 402,404,406,408,410,412,414,416 at desired locations on table 400. Exemplary tile 412 has an exemplary pattern 430 in the form of a square (although virtually any design could be carved into the tile) carved into the tile 412. By locating the tile 412 with the indexing indications 420, 422,426 and/or 428, the tile 412 can be in an expected location when beginning the carving step as will be described below. This can facilitate treating tiles 402,404,406,408,410, 412,414,416 in register. The other tiles 402,404,406,408,410, 414,416 can be similarly positioned in their respective locations.

The design 430 is illustrated as centered front to back 432,434 as well as side to side 436,438. This can be done by precisely locating carvers such as carvers 440,442,444,446, 448,450,452,454, such as with a PLC, or computer 456 which can move the carvers 440,442,444,446,448,450,452,454, such as side to side 436,438 on frame 458, and move the frame 458 forwards and backwards 432,444. Carvers 440,442,444, 446,448,450,452,454 can move together or possibly at least some may move independently of others side to side 436,438 as they may be able to move on drivers such as drivers 460, 462 for side to side movement relative to rail 464. It will be understood that the other carvers 440,442,444,446,448,450, 452,454 may be similarly operably coupled to their respective rails 464, 466. Computer 456 can also provide signals to drivers 468,470 for front to back movement of the frame 458. Drivers 468,470 and 460,462 could work together to provide designs such as curves like circle 472 illustrated on tile 402. Other methods of moving all, or some of, carvers 440,442, 444,446,448,450,452,454, as would be understood by those of ordinary skill in the art could also be employed.

Designs such as circle 472 and square 430 provided as exemplary designs could be carved on the table 400 in a number of different ways in accordance with various embodiments of the invention. First circle 472 could be cut on tiles 402,406 simultaneously and then square 430 could be cut into tiles 412,416 simultaneously or visa versa. Of course more circles 472 or squares 430 than two could be carved at a time as would be understood by those of ordinary skill in the art. With a little more time put into the programming circles 472 and squares 430 could be carved at least somewhat simultaneously, such as with the computer 456 moving the frame 458 from back to front 434,432 (and/or visa versa) while allowing the carvers, such as 452,448 to carve the squares 430 and the carvers 446,442 to carve the circles 472 or portions thereof. It may take more than one pass to complete a particular design and more than one carver may work on portions of a design on any particular tile.

After carving a set of tiles on table 400, the tiles are then removed and another set of tiles placed thereon so that an efficiency can be experienced on a scale not believed to have been provided or suggested by teachings in the prior art. Suction holes 474 may be helpful in holding tiles 402,404, 406,408,410,412,414,416 in position, and lint collection systems (not shown) are anticipated to be utilized to assist in removing cut portions when treatment devices (illustrated as carvers 440,442,444,446,448,450,452,454) remove portions of carpet when carving the tiles 402,404,406,408,410,412, 414,416.

When using carvers 440,442,444,446,448,450,452,454, the widths of the lower pile relative to higher pile may vary depending on the selection of the carving tool. Furthermore, there may be more than one height such as if the tool provides for a curved or angled transition from high to low (i.e., one could think of a router bit with various configurations being possible).

Figure 15:
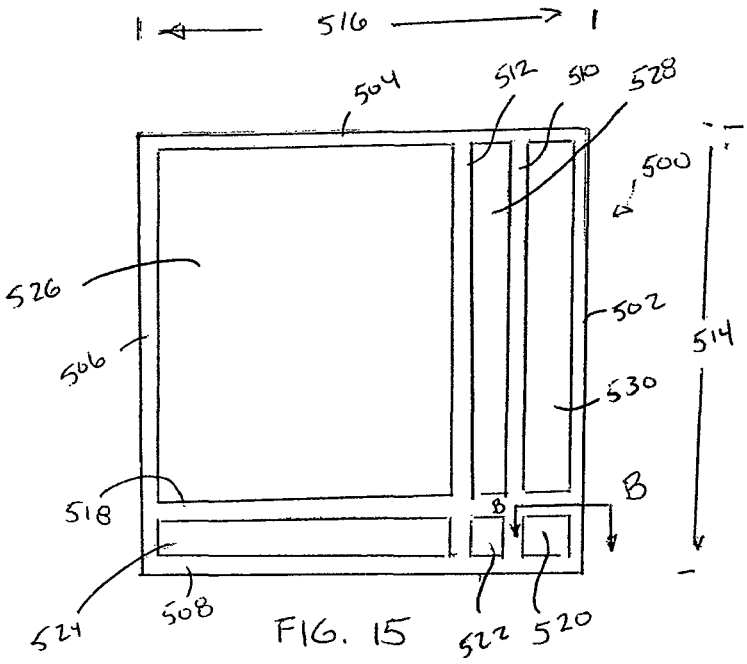
FIG. 15 is a top plan view of a carpet tile constructed in accordance with the presently preferred embodiment of the present invention.

One of the first commercial products made utilizing the method and apparatus shown and described herein is carpet tile 500 shown in FIG. 15. Treatment devices such as carvers, or more appropriately, edgers modified to tip shear a channel with clean edges have been oriented and/or otherwise employed to provide treated portions 502,504,506 and 508 relative to untreated portions 520,522,524,526,528,530. Furthermore, treatment devices are also utilized to provide first and second stripes 510 and 512 extending a length, or at least substantially a length 514. Additionally, stripe 518 is illustrated extending width 516. Stripe 518 is illustrated as being perpendicular to the stripes 510 and 512. In this preferred embodiment, the stripes 510 and 512 and 518 are roughly an inch and a half across while the frame portions 502,504,506, 508 are about ¾ of an inch across on a 24 inch square tile. Of course, other tile dimensions could be utilized in other embodiments and other designs could be provided as well. The stripes 510,512,518 may also be thought of as channels of tip sheared portions separated by untreated loop portions in this embodiment.

Figure 16:
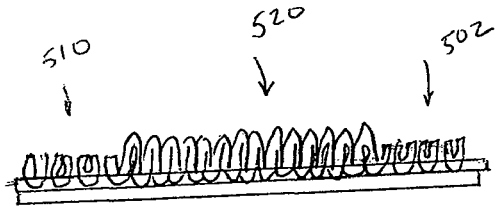
FIG. 16 is a cross section taken on line B-B of FIG. 15.

FIG. 16 illustrates the stripes 510,512,518 as tip sheared portions relative to untreated portion 520 which are loop pile. The tip sheared pile will create a different look than the loop portion even when an identical yarn is utilized with both portions. While all loop pile styles tiles are treated to provide channels of tip sheared portions with this embodiment relative to loop portions, other embodiments may include initially tip sheared pile, multi-level loop pile styles and possibly other styles. Treating these or still other embodiments may include providing a treated portion such as a channel through a portion of tip sheared and/or multi level loop areas. Other treatments could be utilized in still other embodiments including but not limited to channels.

A representative turning station 600 is shown in FIG. 17 which could be utilized in conjunction with or in place of the turning station 38,42 shown in FIG. 2. Turning station 600 has a pin 632 which is an elevationally adjustable arm 604 which can retain, at least temporarily, a portion of tile 606 such as a corner 608. Meanwhile, treatment device 610 such as one having cutter 612 can be elevationally adjusted such as by placing it in a desired position with the pin 602 securing the corner 608, or other portion, of tile 606 and the conveyor 614 continuing to move in its desired direction of travel, therefore rotating the tile 606 about pin 602. While tile 606 is rotating, the cutter 612 can cut curved arc 616 illustrated in phantom. Controller 618 is useful to control the up and down motion of the arm 606, pin 602 and/or treatment device 610. Treatment device 610, in addition to being adjustable elevationally represented by arrows 620 such as by processor 610, may also be adjusted laterally as represented by the arrows 622. Additionally, treatment device 610 may be rotationally oriented such as about its axis 24 as represented by rotation as can be seen from the figure for four axes of movement. Three, five or other axes of movement can be provided with other embodiments.

Of course, in other embodiments it may not be necessary to utilize arm 604 with pin 602, instead it may be that cutter 612 or other treatment device 610 can be moved laterally as shown by arrows 622 such as by control processor 610 and/or rotationally represented by arrow 626 to cut a desired design as the tile travels linearly represented by arrow 628 on conveyor 614. Furthermore, during the process of cutting stripes 16 it may be that processor 618 controls the direction of the treatment device 618 such as elevationally 620 by providing different depths, if at all, and/or laterally 622 and/or rotationally 626.

Furthermore, the conveyor 614 may be controlled by PLCs or other mechanisms so that the tile 606 may be stopped at least momentarily in some embodiments while changing the position of the treatment device 610. In addition to treating a tile 606 on a conveyor 614, it being expressly noted that tiles 606 could be positioned laterally adjacent one another in some embodiments while being treated depending on the width of the conveyor 614, particularly as technology such as that shown in FIG. 18 is employed.

Figure 18:
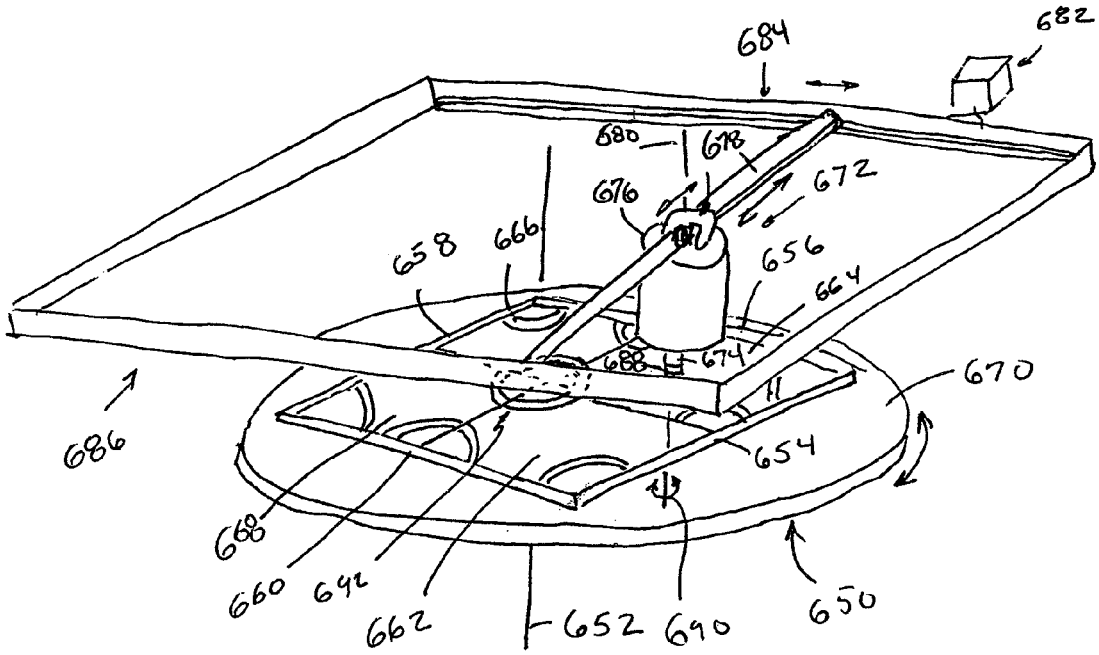
FIG. 18 is a top perspective view of an alternative embodiment.

FIG. 18 shows a turntable 650 rotatable about the axis 652. Turntable 650 may have guides 654,656,658,660 which retain at least a portion of a plurality of tiles 662,664,666,668 in a desired configuration relative to upper surface 670 and turntable 650. Treatment device 672 is illustrated in the relatively sophisticated form of a device having an elevational adjustment such as arm 674 connected to piston 676 which is shown connected to slide 678 with shoulder 680 whereby processor 682 can move the treatment device 672 linearly relative to slide 678 and up and down. Also, slide 678 is preferably operably coupled relative to guides 684,686 which allow for linear movement in a direction such as parallel to that provided by slide 678. However, more or less sophisticated construction can be provided with other embodiments. Accordingly, the illustrated treatment device 672 may be provided with three dimensional axes of control. Other embodiments can provide for four dimensional axes such as providing for the rotation of head 688 about axis 690. Processor 682 may control the speed and/or direction of rotation of turntable 650 about axis 652.

Figure 14:
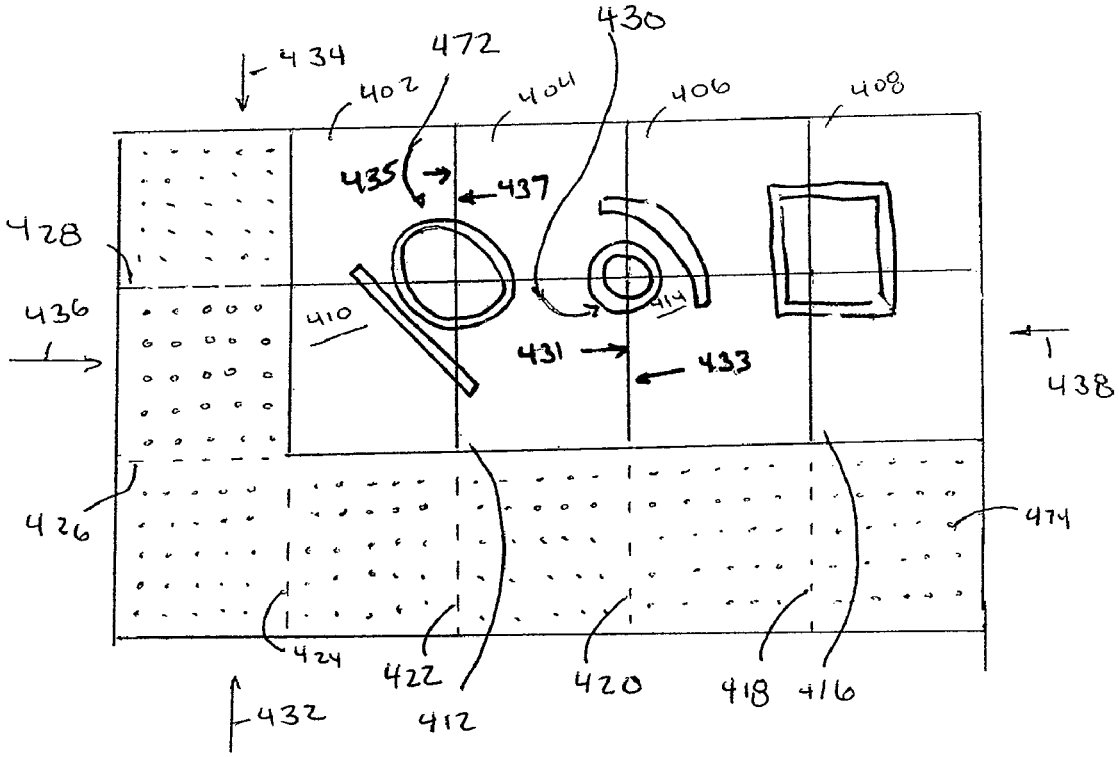
FIG. 14 is a top plan view of the table shown in FIG. 13 with the carvers and frame removed.
Figure 19:
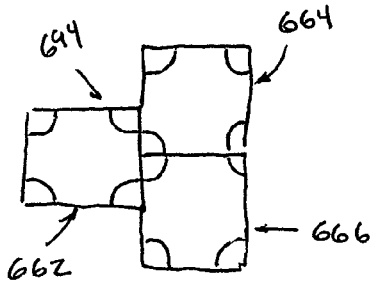
FIG. 19 is a top plan view of tiles manufactured in FIG. 13 and others.

As illustrated in FIG. 18, the treatment device 682 has cut circles in the upper surface of tiles 662,664,666,668. Then the tiles 662,664,666,668 are rotated three times and cut to provide identical circle 690. As occurs in the embodiment of FIG. 14, showing design 472 and 430 extending over edges 431, 433,435,437 of tile such as tiles 412,414,402 and 404 respectively for portions of those design. Similarly, just like the design 690 is preferably cut continuously with the cutter 688 in communication with tile 662,664,666,668 as the table 650 rotates and the cutter proceeds from one tile such as tile 662,664,666,668 to the next in sequential order or other order. Similar construction can occur with that of FIG. 14 when the cutter cuts the design such as circle or lips 434,72 across multiple tiles. In installations, it may be possible to orient those tiles to provide the same design such as is shown of an overall design such as is shown in FIG. 14 or alternatively, FIG. 19 is provided where by a serpentine pattern 694 is created by the tiles 662,664,666,668 by providing them in a brick style arrangement. Furthermore, still other embodiments could be provided by utilizing tiles such as tile 662, 664,666,668 in different arrangements than as cut when on table 650.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of manufacturing decorative carpet tiles comprising:

providing at least one carpet tile tufted to at least one height with first, second, third and fourth side edges forming a rectangular perimeter, and with a modular tile backing, said carpet tile having an upper surface;

and then providing relative movement between the carpet tiles and at least one treatment device, wherein the step of providing relative motion further comprises turning the tile while treating the tile; and treating at least a portion of the upper surfaces of the carpet tiles with the treatment device to provide a first separation internal to the rectangular perimeter which is curved relative to at least one of the first, second, third and fourth edges and to respectively provide a second separation internal to the rectangle while providing the first separation when treating the first portion.

2. The method of claim 1 wherein the treatment step further comprises a step of carving first a first tile the first edge and then across an edge of an adjacent tile to provide a treated portion of the adjacent tile.

3. The method of claim 1 wherein the treatment device is controlled by a controller configured to at least direct relative movement of the treatment device relative to the carpet tile to at least assist in providing at least one predetermined pattern on the carpet tile during the step of treating the carpet tile.

4. The method of claim 3 wherein the at least one predetermined pattern is a portion of at least one design extending over edges of adjacent tiles and the at least one design is simultaneously provided in at least two carpet tiles as provided during the step of treating the carpet tiles.

5. The method of claim 4 wherein the relative motion step further provides rotating the tile about an axis.

6. The method of claim 5 wherein the axis of rotation is not centrally located relative to the tile.

7. The method of claim 1 wherein as a result of treating the at least two carpet tiles, the at least two carpet tiles have identical designs thereon.

8. The method of claim 1 wherein after treating at least two carpet tiles, the at least two carpet tiles are installed providing a different overall design than as treated.

9. The method of claim 5 wherein during the treatment step, the tile is supported by a turntable.

10. The method of claim 8 wherein the treatment device traverses one of the first edge, second edge, third edge and fourth edge to contain simultaneously treating a second tile adjacent the first edge on the turn table.

* * * * *